US009188911B1

(12) United States Patent
Takenaka

(10) Patent No.: US 9,188,911 B1
(45) Date of Patent: Nov. 17, 2015

(54) IMAGE FORMING APPARATUS AND IMAGE FORMING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Sunao Takenaka, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/633,237

(22) Filed: Feb. 27, 2015

(51) Int. Cl.
*G03G 15/16* (2006.01)

(52) U.S. Cl.
CPC ..... *G03G 15/163* (2013.01)

(58) Field of Classification Search
None
See application file for complete search history.

(56) References Cited

U.S. PATENT DOCUMENTS 8,874,020 B2 10/2014 Mita et al.
2013/0108339 A1 * 5/2013 Mita et al. ..... 399/341

* cited by examiner

*Primary Examiner* — Clayton E Laballe
*Assistant Examiner* — Jas Sanghera
(74) *Attorney, Agent, or Firm* — Amin, Turocy & Watson, LLP

(57) ABSTRACT

In accordance with an embodiment, an image forming apparatus comprises an image forming section, a transfer section, a bias voltage control section, a decoloring section and a control section. The image forming section forms a toner image with decolorable toner. The transfer section transfers the toner image on a medium. The bias voltage control section controls a bias voltage to be applied to the transfer section. The decoloring section decolors the decolorable toner on the medium. The control section controls, in a case where the decoloring section decolors the medium, the bias voltage control section to form an electric field in a direction opposite to that of an electric field formed at the time of an image formation.

8 Claims, 8 Drawing Sheets

IMAGE FORMING APPARATUS AND IMAGE FORMING METHOD

FIELD

Embodiments described herein relate generally to an image forming apparatus and an image forming method.

BACKGROUND

Conventionally, there is an image forming apparatus having a decoloring mode in which an image formed on paper is decolored. For example, the image forming apparatus heats the paper on which the image is printed with decolorable toner at a constant temperature to decolor the image. In this way, the image forming apparatus can make the paper printed with the decolorable toner reusable.

During the decoloring processing, each device in the image forming apparatus is controlled and the paper-passing is performed, similar to that during the general image forming processing. During the decoloring processing, the temperature of a fixing device is set to the decoloring temperature of toner to heat the paper.

The paper, on which the toner is fixed, has a high chargeability. This interferes with the conveyance of paper in the decolorizing process. Thus, it is considered to set, during the decoloring processing, the absolute value of a transfer bias voltage to be applied to a transfer device to 0 or a value smaller than that at the time of an image formation. However, when setting the absolute value of the transfer bias voltage to 0 or a value smaller than that at the time of the image formation, the following problems may occur.

The image forming apparatus using two-component developer controls the applying timing or terminating timing of a charging bias voltage and a developing bias voltage when the image forming processing is started and the image forming processing is ended. Through these control process, a carrier constituting the developer can be prevented from being adhered to a photoconductor. At this time, a small quantity of toner adheres to the photoconductor. Thus, if the absolute value of the transfer bias voltage is set to 0 or a smaller value during the decoloring processing, the toner adhered to the photoconductor may be adhered to the transfer device, which will stain the paper.

DETAILED DESCRIPTION

In accordance with an embodiment, an image forming apparatus comprises an image forming section, a transfer section, a transfer bias voltage control section, a decoloring section and a control section. The image forming section forms a toner image with decolorable toner. The transfer section transfers the toner image on a medium. The transfer bias voltage control section controls a transfer bias voltage to be applied to the transfer section. The decoloring section decolors the decolorable toner on the medium. The control section controls, in a case where the decoloring section decolors the medium, the transfer bias voltage control section to form an electric field in a direction opposite to that of an electric field formed at the time of an image formation.

A First Embodiment

Figure 1:
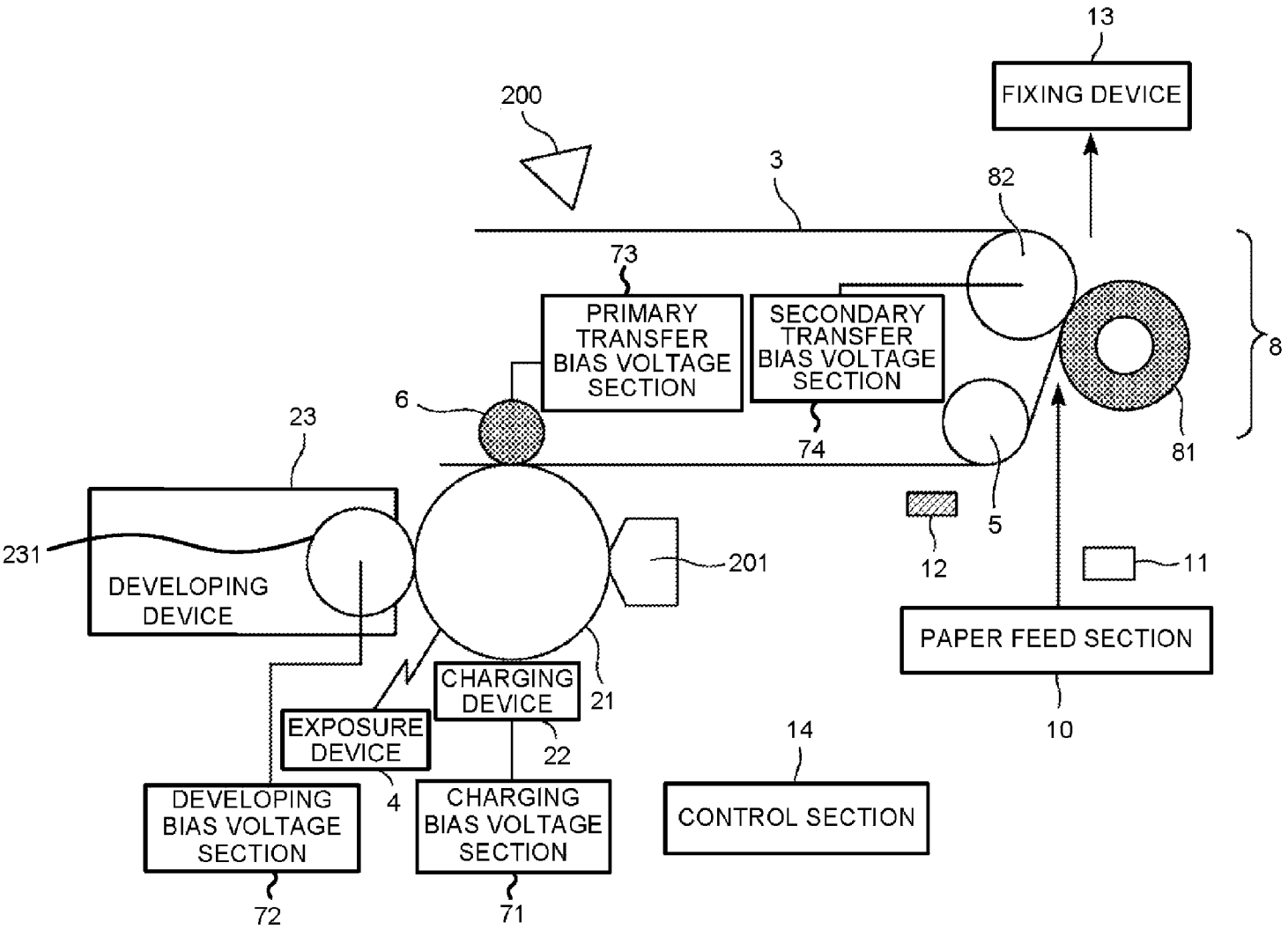
FIG. 1 is a diagram illustrating an example of the constitution of an image forming apparatus according to a first embodiment.

Hereinafter, the image forming apparatus of the first embodiment is described with reference to the accompanying drawings. FIG. 1 is a diagram illustrating an example of the constitution of an image forming apparatus 1 according to the embodiment. The image forming apparatus 1 is an image forming apparatus of an intermediate transfer system.

The image forming apparatus 1 comprises an image forming section 2, an intermediate transfer belt 3, an exposure device 4, a tension roller 5, a primary transfer roller 6, a power supply section 7, a transfer section 8, a paper feed section 10, a paper sensor 11, a toner adhesion amount sensor 12, a fixing device 13 and the control section 14.

The image forming section 2 includes a photoconductor 21, a charging device 22 and a developing device 23.

The photoconductor 21 is provided with an organic photo conductor (OPC) on the surface thereof.

The charging device 22 charges the surface of the photoconductor 21 uniformly. For example, the charging device 22 is a scorotron corona charger.

The developing device 23 includes a developing roller 231. In the developing device 23, the developer is stored. The developer is the mixture of decolorable toner and magnetic carrier. For example, the decolorable toner includes a color generation compound, a color developing agent and a decoloring agent. For example, the magnetic carrier core agent is a Mn—Mg ferrite. The magnetic carrier coating agent having a toner charging capability is, for example, a silicone-based resin and the like. Further, a conductive agent is contained in a coating agent to adjust the electrical resistance of the carrier, and for example, a carbon black may be used as the conductive agent.

The image formed with the decolorable toner is decolored when being heated to a temperature above a decoloring temperature D1. The decoloring temperature D1 is a temperature higher than the temperature of a fixing processing. For example, the temperature of the fixing processing is 95 degrees centigrade while the decoloring temperature D1 is 110 degrees centigrade.

The developing roller 231 is applied with a developing bias voltage from the power supply section 7. Through the developing bias voltage, the developer is supplied to the photoconductor 21. Then, an electrostatic latent image formed on the photoconductor 21 through the exposure device 4 is formed as a toner image.

The intermediate transfer belt 3 abuts against the primary transfer roller 6, and is stretched by the tension roller 5.

The exposure device 4 acquires image data from the control section 14, and irradiates the photoconductor 21 with a laser light corresponding to the acquired image data. The exposure device 4 scans the laser light in the axial direction of the photoconductor 21. The laser light is scanned and exposed to form an electrostatic latent image on the photoconductor 21.

The primary transfer roller 6 is a conductive roller. The primary transfer roller 6 is opposite to and pressed against the photoconductor 21 across the intermediate transfer belt 3. Further, a transfer bias voltage is applied to the primary transfer roller 6 from the power supply section 7. In this way, the toner image is transferred (primarily transferred) to the intermediate transfer belt 3.

The transfer section 8 is provided with a secondary transfer roller 81 and an opposing roller 82. The secondary transfer roller 81 is a conductive roller. The opposing roller 82 faces the secondary transfer roller 81. A given secondary transfer bias voltage is applied to the secondary transfer roller 81 or the opposing roller 82 from the power supply section 7. In the present embodiment, the given secondary transfer bias voltage is applied to the opposing roller 82 from the power supply section 7. In this way, the transfer section 8 transfers (secondarily transfers) the toner image on the intermediate transfer belt 3 to a paper serving as a medium. Further, after the secondary transfer processing is ended, the intermediate transfer belt 3 is cleaned by a belt cleaner 200.

The paper feed section 10 is used for storing papers. For example, the paper is a decolored paper subjected to decoloring processing. The paper feed section 10 feeds paper to the secondary transfer roller 81.

The paper sensor 11 is a detection section for detecting that a paper is fed by the paper feed section. If the paper is detected, the paper sensor 11 outputs a detection signal to the control section 14.

The toner adhesion amount sensor 12 detects the toner amount adhered to the intermediate transfer belt 3. The toner adhesion amount sensor 12 outputs a signal corresponding to the detected toner amount.

The fixing device 13 heats and presses the paper on which the toner image is transferred to fix the toner image on the paper.

Figure 2:
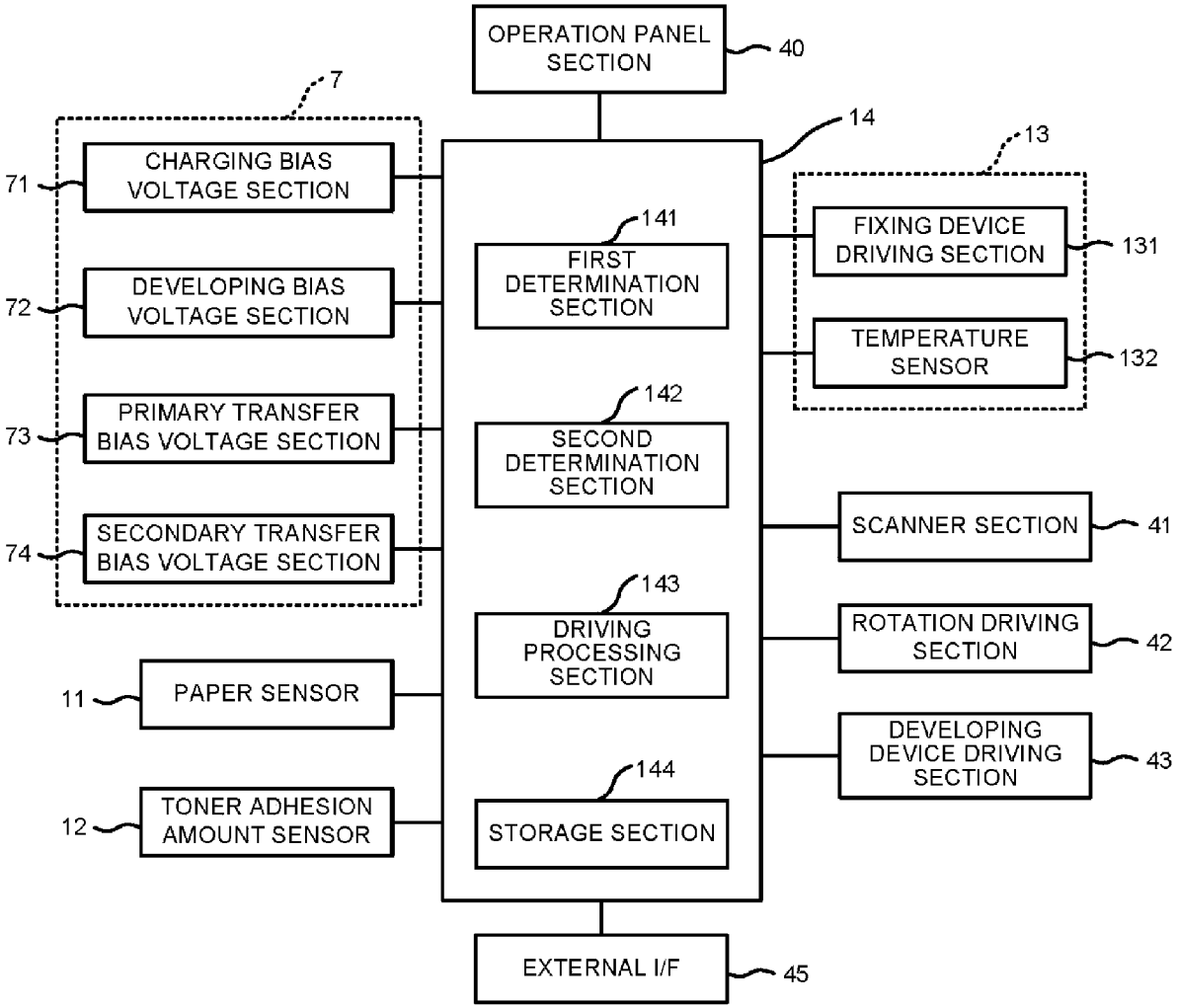
FIG. 2 is a control block diagram illustrating the image forming apparatus according to the first embodiment.

FIG. 2 is a control block diagram illustrating the image forming apparatus 1 according to the embodiment.

The control section 14 controls the operations of the image forming apparatus 1. The control section 14 is connected with the power supply section 7, the paper sensor 11, the toner adhesion amount sensor 12, the fixing device 13, an operation panel section 40, a scanner section 41, a rotation driving section 42, a developing device driving section 43 and an external I/F (interface) 45.

The fixing device 13 includes a fixing device driving section 131 and a temperature sensor 132. The fixing device driving section 131 is provided with a heat source. If a signal is received from the control section 14, the fixing device driving section 131 applies a voltage to the heat source. The heat source generates heat if being applied with the voltage by the fixing device driving section 131. Thus, as the heat source generates heat, the temperature of the fixing device 13 is raised.

The temperature sensor 132 measures a temperature D of the fixing device 13, and then outputs the measured temperature D to the control section 14.

The operation panel section 40 functions as a user interface. The operation panel section 40 outputs the operation information based on the operation from an operator to the control section 14. The operation panel section 40 is provided with an operation section and a display section. The operation section receives an operation from the operator, and the display section displays an operation guide and the like to the operator.

The scanner section 41 acquires image information from a document. The scanner section 41 converts the acquired image information into image data, and then outputs the image data to the control section 14.

The rotation driving section 42 receives a first driving signal from the control section 14. If the first driving signal is received, the rotation driving section 42 drives the photoconductor 21 and the intermediate transfer belt 3.

The developing device driving section 43 receives a second driving signal from the control section 14. If the second driving signal is received, the developing device driving section 43 drives the developing roller 231.

The power supply section 7 is provided with a charging bias voltage section 71, a developing bias voltage section 72, a primary transfer bias voltage section 73 and a secondary transfer bias voltage section 74.

If a first bias voltage signal is received from the control section 14, the charging bias voltage section 71 applies a charging bias voltage to the charging device 22. In this way, the charging device 22 charges the surface of the photoconductor 21 uniformly.

If a second bias voltage signal is received from the control section 14, the developing bias voltage section 72 applies a developing bias voltage to the developing roller 231.

If a third bias voltage signal is received from the control section 14, the primary transfer bias voltage section 73 applies a primary transfer bias voltage to the primary transfer roller 6.

If a fourth bias voltage signal is received from the control section 14, the secondary transfer bias voltage section 74 (transfer bias voltage control section) applies a secondary transfer bias voltage to the opposing roller 82.

If a fifth bias voltage signal is received from the control section 14, the secondary transfer bias voltage section 74 applies a reverse bias voltage to the opposing roller 82. The reverse bias voltage is a reverse-polarity voltage with respect to the secondary transfer bias voltage. That is, the direction of an electric field when the reverse-polarity voltage is applied is opposite to that of an electric field when the secondary transfer bias voltage is applied. The electric field refers to the electric field generated between the secondary transfer roller 81 and the opposing roller 82. In the present embodiment, as the decolorable toner has a negative polarity, the secondary transfer bias voltage is a negative polarity voltage. The reverse bias voltage is a positive polarity voltage.

The external I/F 45 receives the image data sent from an external machine such as a PC, and then outputs the received image data to the control section 14.

The control section 14 receives the operation information from the operation panel section 40. The control section 14 executes either a printing mode or a decoloring mode based on the operation information. The printing mode is a mode for printing an image on a paper by heating and pressing the paper on which the toner image is transferred to fix the toner image on the paper. Thus, in the decoloring mode, the fixing device 13 functions as a decoloring section which decolors the decolorable toner on the paper. The decoloring mode is a mode for decoloring an image by heating the paper printed with the decolorable toner to a temperature above the decoloring temperature. In the decoloring mode, as the image data is not printed, the photoconductor 21 is not exposed. Further, in the present embodiment, it is possible to perform the printing mode by applying the conventional technologies, and therefore the description thereof is not provided.

The control section 14 calculates the toner adhesion amount based on the signal corresponding to the toner amount detected by the toner adhesion amount sensor 12. The control section 14 controls to feedback an image formation condition such as a developing bias voltage on the basis of the calculated toner adhesion amount.

The control section 14 includes a first determination section 141, a second determination section 142, a driving processing section 143 and a storage section 144.

The first determination section 141 acquires a temperature D of the fixing device 13 from the temperature sensor 132 when the decoloring mode is started. The first determination section 141 determines whether or not the temperature D is above the decoloring temperature D1. In a case where it is determined that the temperature D is above the decoloring temperature D1, the driving processing section 143 outputs the first driving signal to the rotation driving section 42. In addition, the driving processing section 143 outputs the first bias voltage signal to the charging bias voltage section 71. The driving processing section 143 outputs the second bias voltage signal to the developing bias voltage section 72. At this time, in order to prevent the carrier attraction, the driving processing section 143 outputs the second bias voltage signal after a given time elapses from the moment the first bias voltage signal is outputted. That is, the driving processing section 143 applies the developing bias voltage immediately before the charged portion of the photoconductor reaches the developing position. However, at this time, a toner band is developed on a part of the photoconductor 21 where the developing potential generated through the developing bias voltage is higher than the photoconductor potential generated through the charging bias voltage. The toner band is a belt-like toner image. The developed toner image reaches the secondary transfer roller 81 through the intermediate transfer belt 3. Then, the secondary transfer roller 81 is stained by the reached toner image. Thus, the driving processing section 143 outputs the fifth bias voltage signal to the secondary transfer bias voltage section 74. That is, the toner band is prevented from being adhered to the secondary transfer roller 81 by applying the reverse bias voltage to the opposing roller 82. Further, the carrier attraction refers to a phenomenon that the magnetic carrier is moved towards the photoconductor 21 by the force of the electric field. The carrier attraction occurs in a case where the photoconductor potential is largely higher than the developing potential at the developing position. This phenomenon occurs when the charged portion of the photoconductor reaches the developing position before the developing bias voltage is applied to the developing device. Further, in the present embodiment, since the charge polarity of the decolorable toner is negative, the case in which the potential is high means that the potential at the negative side is high. That is, the potential of which the absolute value is high is represented as a high potential.

The second determination section 142 determines whether or not the detection signal is acquired from the paper sensor 11. If it is determined that the detection signal is acquired, the driving processing section 143 calculates a time taken to move the paper from the paper sensor 11 to the transfer section 8. Then, the driving processing section 143 stops the output of the fifth bias voltage signal to the secondary transfer bias voltage section 74. If it is determined that the detection signal is acquired in the decoloring mode, the driving processing section 143 calculates the time taken to move the paper from the paper sensor 11 to the transfer section 8. Then, the driving processing section 143 stops the output of the fifth bias voltage signal to the secondary transfer bias voltage section 74. That is, the driving processing section 143 stops the applying of the reverse bias voltage to the paper. In this way, the paper is prevented from being charged with unnecessary charge.

The storage section 144 stores the decoloring temperature D1.

The driving processing section 143 stops the output of the first bias voltage signal to the charging bias voltage section 71 when the decoloring mode is ended. The driving processing section 143 stops the output of the second bias voltage signal to the developing bias voltage section 72 after a given time elapses from the moment the output of the first bias voltage signal is stopped. At this time, similar to that described above, as the toner band is developed, the driving processing section 143 outputs the fifth bias voltage signal to the secondary transfer bias voltage section 74.

Figure 3:
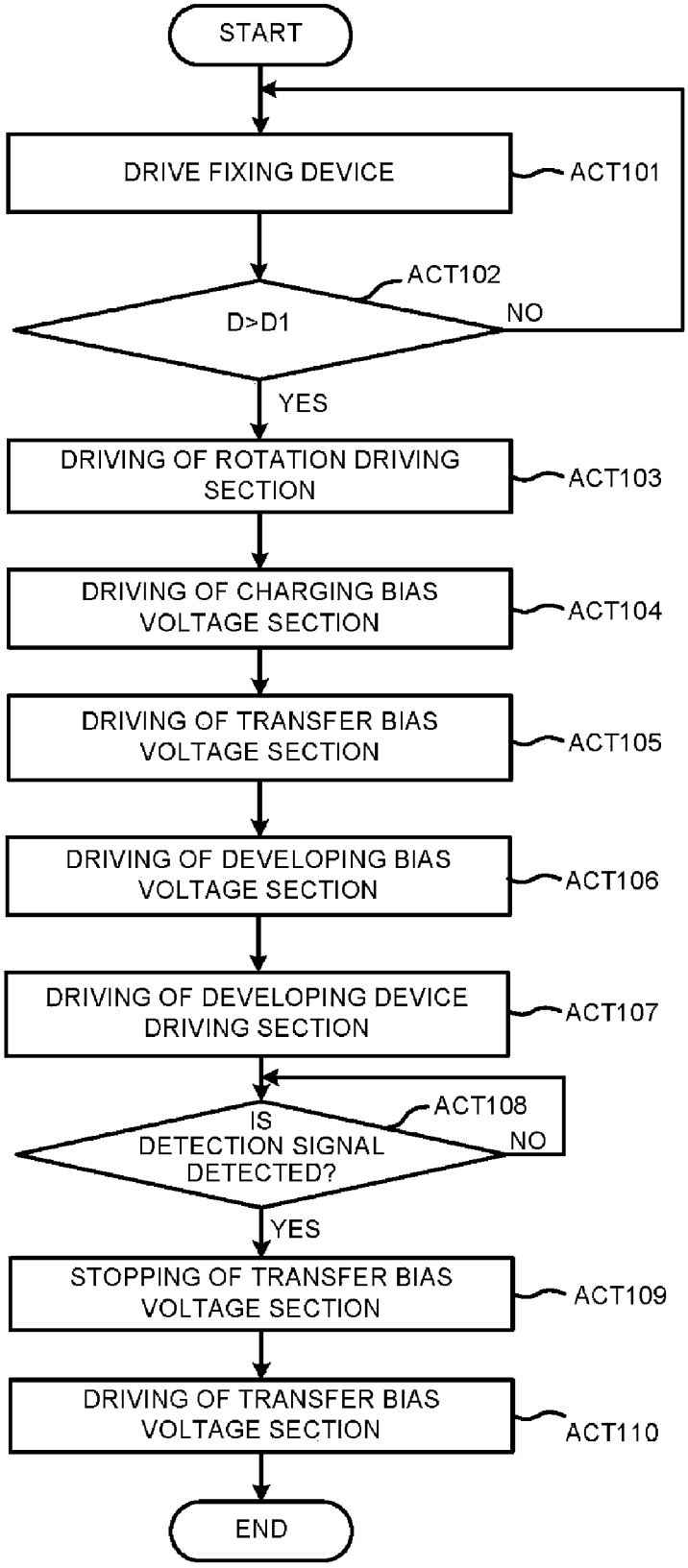
FIG. 3 is a diagram illustrating an operation flow of a control section in a decoloring mode according to the first embodiment.
Figure 4:
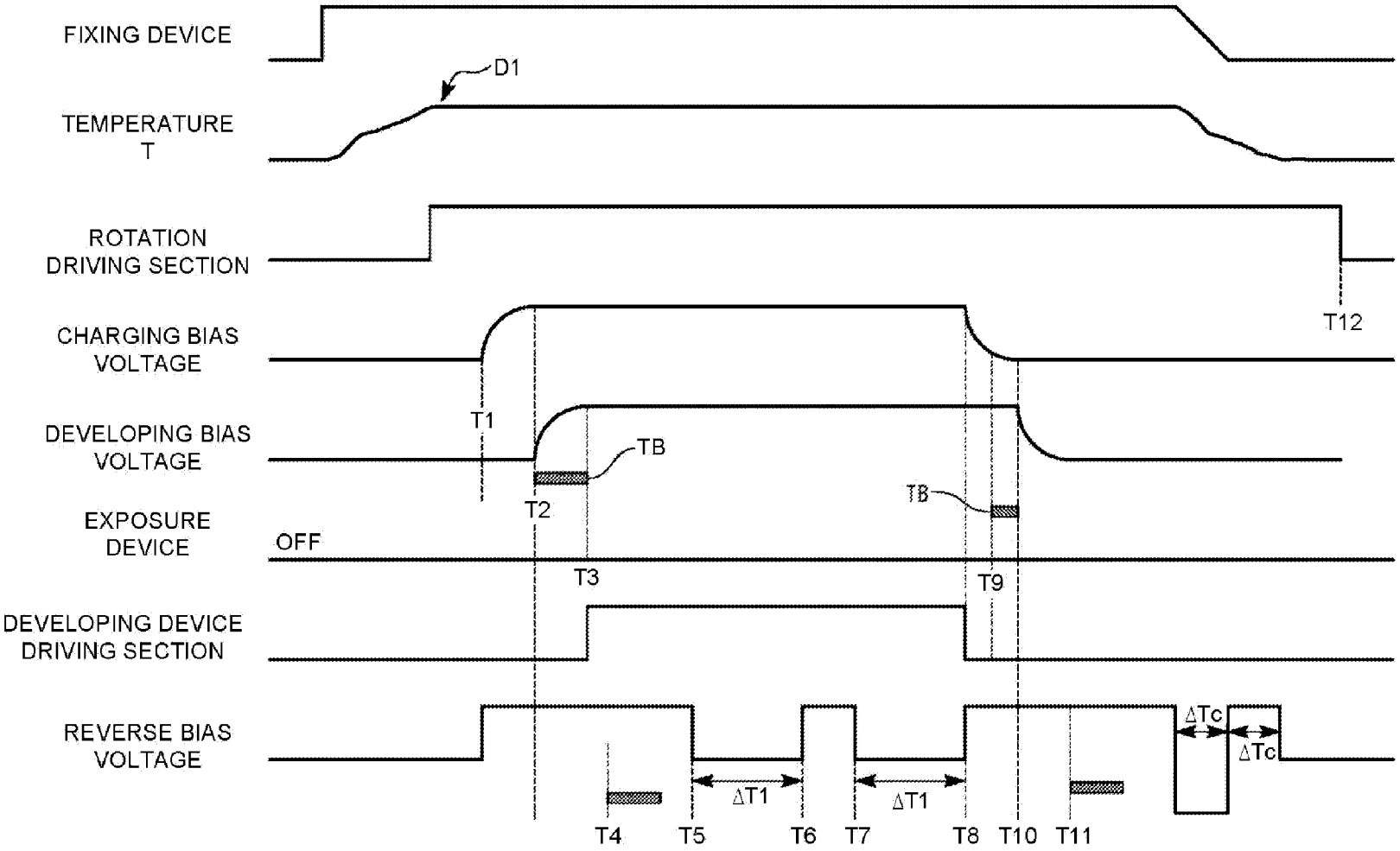
FIG. 4 is a diagram illustrating an operation timing of a control section 14 in the decoloring mode according to the first embodiment.

Next, the operations of the control section 14 in the decoloring mode are described with reference to the accompanying drawings. FIG. 3 is a diagram illustrating the operation flow of the control section 14 in the decoloring mode. FIG. 4 is an operation timing chart of the control section 14 in the decoloring mode. Further, the paper printed with the decolorable toner is set in the paper feed section 10 after being used.

The user executes an operation for decoloring an image. For example, the user presses a start button which is arranged on the operation section of the operation panel section 40 to be used for decoloring image. The operation panel section 40 acquires the operation information for instructing the control section 14 to execute the decoloring mode. In this way, the control section 14 executes the decoloring mode.

The control section 14 drives the fixing device 13 (ACT 101). The control section 14 sends a signal to the fixing device driving section 131. If the signal is received from the control section 14, the fixing device driving section 131 applies a voltage to the heat source. The temperature of the fixing device 13 is raised through the heat generated by the heat source.

The first determination section 141 acquires a temperature D from the temperature sensor 132 every a certain period. The first determination section 141 determines whether or not the temperature D is above the decoloring temperature D1 (ACT 102). In a case where it is determined that the temperature D is above the decoloring temperature D1 (YES in ACT 102), the driving processing section 143 outputs the first driving signal to the rotation driving section 42. In a case where it is determined that the temperature D is below the decoloring temperature D1 (NO in ACT 102), the first determination section 141 executes the processing in ACT 101 again. If the first driving signal is received, the rotation driving section 42 drives the photoconductor 21 and the intermediate transfer belt 3 (ACT 103).

The driving processing section 143 outputs the first bias voltage signal to the charging bias voltage section 71 at a timing T1. If the first bias voltage signal from the driving processing section 143 is received, the charging bias voltage section 71 applies a charging bias voltage to the charging device 22 (ACT 104).

The driving processing section 143 outputs the fifth bias voltage signal to the secondary transfer bias voltage section 74 at the timing T1. If the fifth bias voltage signal from the control section 14 is received, the secondary transfer bias voltage section 74 applies the reverse bias voltage to a roller facing the secondary transfer roller 81 (ACT 105).

The driving processing section 143 outputs the second bias voltage signal to the developing bias voltage section 72 at a timing T2. If the second bias voltage signal is received from the driving processing section 143, the developing bias voltage section 72 applies a developing bias voltage to the developing roller 231 (ACT 106).

The time period between the timings T1 and T2 is set to a time when the carrier attraction isn't caused. Thus, the time period between the timings T1 and T2 is set to be shorter than a time taken to move the surface of the photoconductor for a distance between the charging device 22 and the developing roller 231. A timing T3 is a timing when the charged portion of the photoconductor 21 reaches the position of the developing roller 231. Thus, during the time period between the timings T2 and T3, since the potential of the developing roller 231 is higher than the surface potential of the photoconductor 21, a toner band TB is developed on the photoconductor 21.

The driving processing section 143 outputs the second driving signal to the developing device driving section 43. If the second driving signal is received, the developing device driving section 43 drives the developing roller 231 (ACT 107). The developed toner band TB is transferred to the intermediate transfer belt 3 that abuts against the photoconductor 21. The transferred toner band TB is conveyed to the secondary transfer roller 81 through the intermediate transfer belt 3. At a timing T4, the transferred toner band TB reaches the secondary transfer roller 81. At this time, the reverse bias voltage is applied to the opposing roller 82. That is, an electric field of which the direction is opposite to that of an electric filed when the secondary transfer bias voltage is applied is generated at a space between the secondary transfer roller 81 and the opposing roller 82. Thus, the transferred toner band TB passes through the secondary transfer roller 81 without being adhered to the secondary transfer roller 81.

The second determination section 142 determines whether or not the detection signal is detected from the paper sensor 11 (ACT 108). In a case where it is determined that the detection signal isn't detected (NO in ACT 108), the second determination section 142 executes the processing in ACT 108 again. In a case where it is determined that the detection signal is detected (YES in ACT 108), the driving processing section 143 calculates the time required for the movement of paper from the paper sensor 11 to the secondary transfer section. Then, the driving processing section 143 stops the output of the fifth bias voltage signal (ACT 109). The secondary transfer bias voltage section 74 stops the applying of the reverse bias voltage to the opposing roller 82. Then, the driving processing section 143 stops the output of the fifth bias voltage signal during a time period of a time ΔT1 from a moment (timing T5) the paper reaches the secondary transfer roller 81. The ΔT1 is the time interval from the moment the paper reaches the secondary transfer roller 81 to the moment (timing T6) the paper passes through the secondary transfer roller 81. If the paper passes through the secondary transfer roller 81, the driving processing section 143 outputs the fifth bias voltage signal to the secondary transfer bias voltage section 74 (ACT 110).

Figure 5:
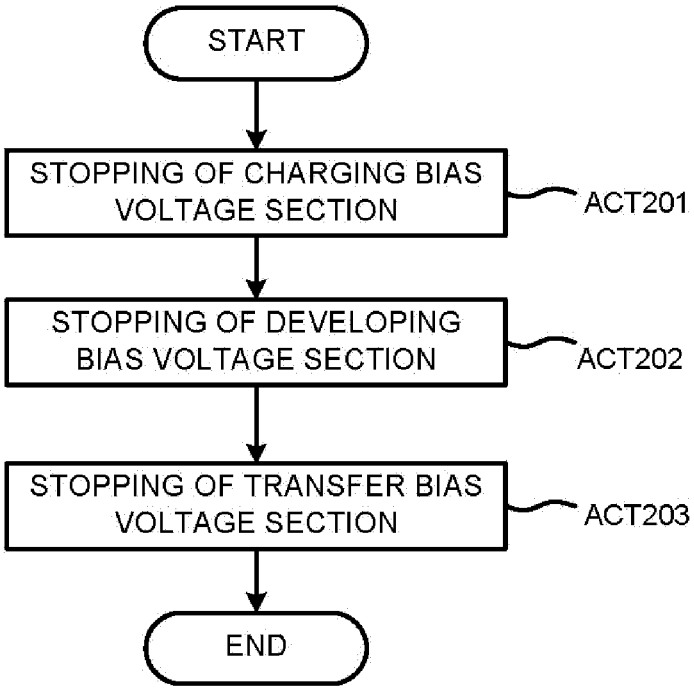
FIG. 5 is a diagram illustrating an operation flow of the control section 14 in the decoloring mode according to the first embodiment.

Next, the operations of the control section 14 when the decoloring mode is stopped are described with reference to the accompanying drawings. FIG. 5 is a diagram illustrating the operation flow of the control section 14 in the decoloring mode.

The driving processing section 143 stops the output of the first bias voltage signal to the charging bias voltage section 71. The charging bias voltage section 71 stops the applying of the charging bias voltage to the charging device 22 (ACT 201). The driving processing section 143 stops the output of the second bias voltage signal to the developing bias voltage section 72 at a timing T10. The developing bias voltage section 72 stops the applying of the developing bias voltage to the developing roller 231 (ACT 202). In order to prevent the carrier adhesion to the photoconductor 21, the time period between the timings T8 and T10 is set to be longer than the time period between the timings T8 and T9. The time period between the timings T8 and T9 is the time taken to move the surface of the photoconductor 21 from a charged position to the developing position. Thus, even if the part of the photoconductor 21 where the surface potential is low reaches the developing position, the driving processing section 143 doesn't stop the applying of the developing bias voltage to the developing roller 231. During the time period between the timings T9 and T10, the potential of the developing roller 231 becomes higher than the surface potential of the photoconductor 21. Thus, the toner band TB is developed on the photoconductor 21. The developed toner band TB is transferred to the intermediate transfer belt 3 that abuts against the photoconductor 21. The transferred toner band TB is conveyed to the secondary transfer roller 81 through the intermediate transfer belt 3. The transferred toner band TB reaches the secondary transfer roller 81 at a timing T11. At this time, a reverse bias voltage is applied to the opposing roller 82. That is, an electric field of which the direction is opposite to that of an electric filed when the secondary transfer bias voltage is applied is generated at a space between the secondary transfer roller 81 and the opposing roller 82. Thus, the transferred toner band TB passes through the secondary transfer roller 81 without being adhered to the secondary transfer roller 81. If the toner band TB passes through the secondary transfer roller 81, the driving processing section 143 stops the output of the fifth bias voltage signal. The secondary transfer bias voltage section 74 stops the applying of the reverse bias voltage to the opposing roller 82 (ACT 203). Further, when the applying of the reverse bias voltage is stopped, an alternating bias voltage processing may be performed. The alternating bias voltage processing refers to a processing executed for cleaning the fogging toner adhered to the secondary transfer roller 81. That is, the secondary transfer bias voltage section 74 applies a bias voltage of a polarity equal to the charging polarity of toner and a bias voltage of a polarity opposite to the charging polarity of toner to the opposing roller 82 alternatively. For example, during the applying time ΔTc of each of the bias voltage of a polarity equal to the charging polarity of toner and the bias voltage of a polarity opposite to the charging polarity of toner, the secondary transfer roller 81 rotates for one circle. Since the electricity charge amount of the fogging toner is low, the charging amount of the toner is distributed in both positive side and negative side. Thus, if the secondary transfer bias voltage having both positive polarity and negative polarity is applied to the opposing roller 82, the secondary transfer roller 81 may be cleaned easily.

If the toner band is cleaned by the belt cleaner 200, the rotation driving section 42 stops the driving of the photoconductor 21 and the intermediate transfer belt 3.

Further, in the embodiment described above, the developing device 23 is driven in the decoloring mode; however, the present invention is not limited to this. For example, the developing device may be stopped. In addition, the developing device may be driven or stopped locally.

A Second Embodiment

Figure 6:
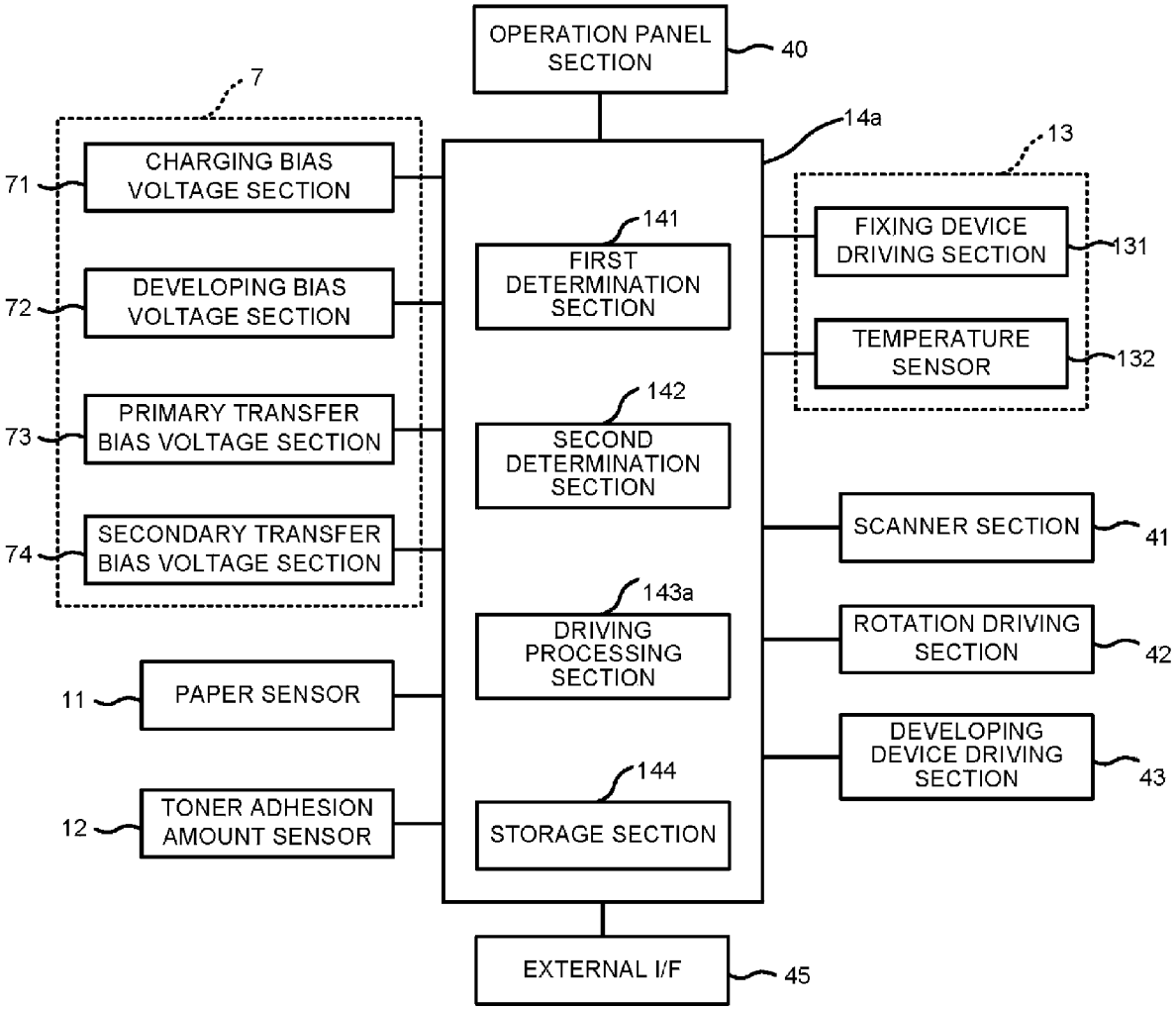
FIG. 6 is a control block diagram illustrating an image forming apparatus according to a second embodiment.

Hereinafter, the image forming apparatus according to the second embodiment is described with reference to the accompanying drawings. FIG. 6 is a control block diagram illustrating an image forming apparatus 1*a* according to the second embodiment. A control section 14*a* of the image forming apparatus 1*a* according to the second embodiment is applied in place of the control section 14 according to the first embodiment. The control section 14*a* has the same functions as the control section 14 and a control function when the decoloring mode is performed for a long time. Further, the same constitutions as the first embodiment are applied with the same reference numerals and therefore the description thereof is not provided.

The control section 14*a* controls the operations of the image forming apparatus 1*a*. The control section 14*a* is connected with the power supply section 7, the paper sensor 11, the toner adhesion amount sensor 12, the fixing device 13, the operation panel section 40, the scanner section 41, the rotation driving section 42, the developing device driving section 43 and the external I/F (interface) 45.

The control section 14*a* comprises the first determination section 141, the second determination section 142, a driving processing section 143*a* and the storage section 144.

The driving processing section 143*a* develops a toner band on the photoconductor 21 after a given time elapses from a moment the decoloring mode is started. If the decoloring mode is continued for a long time, since it is an operation mode without printing, there is almost no transfer residual toner, as a result, a state in which the toner isn't adhered to a cleaner blade 201 is continued. Consequently, the friction between the cleaner blade 201 and the photoconductor 21 is increased since the photoconductor 21 is being rotated. Thus, the blade will be curled as the increase of the friction. For this reason, the driving processing section 143*a* develops the toner band on the photoconductor 21 after the given time elapses from a moment the decoloring mode is started. In this way, the decolorable toner is moved to the cleaner blade 201. That is, the decolorable toner used in the developing processing serves as a lubricant, thereby reducing the friction force between the cleaner blade 201 and the photoconductor 21.

Figure 7:
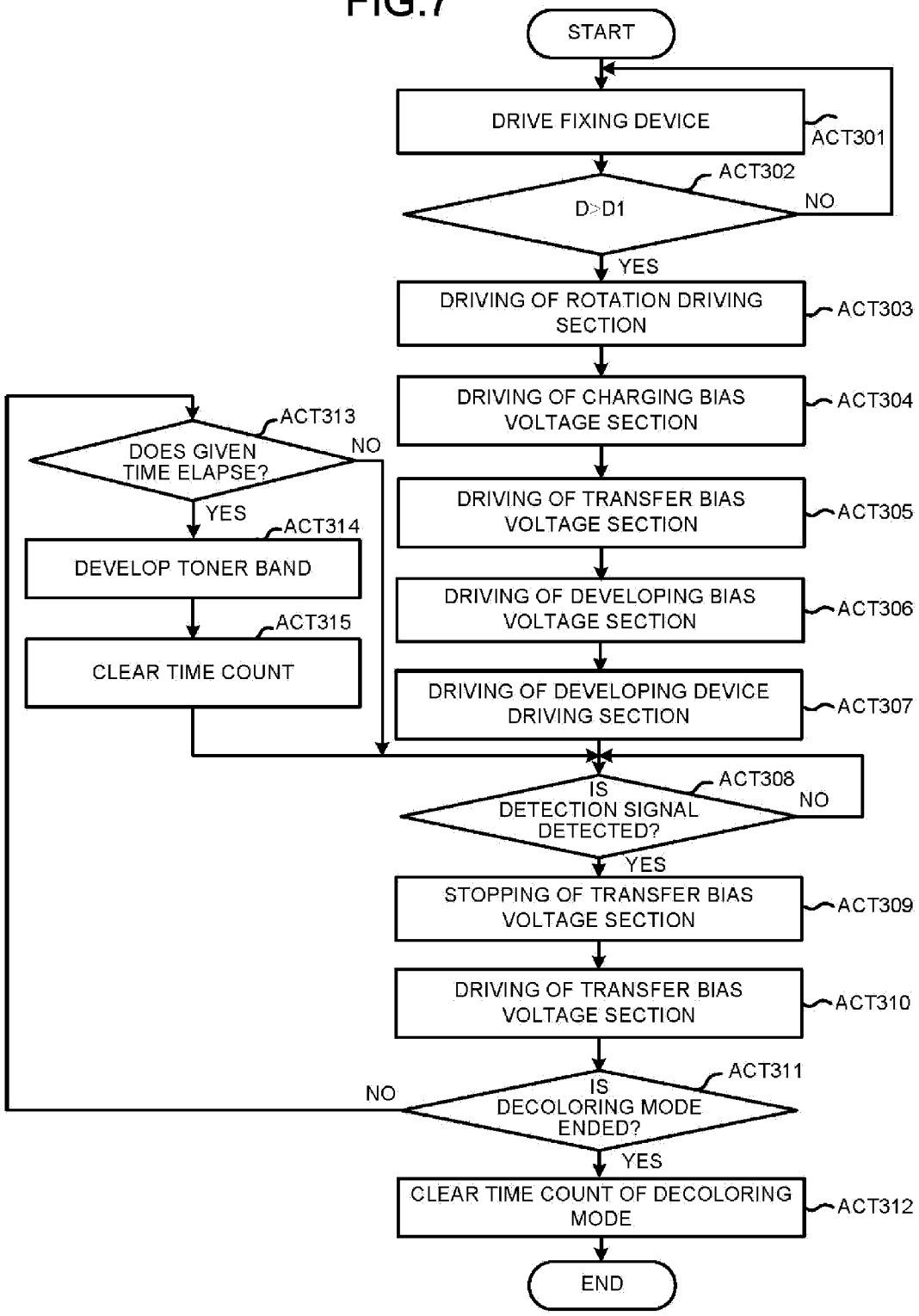
FIG. 7 is a diagram illustrating an operation flow of a control section in a decoloring mode according to the second embodiment.
Figure 8:
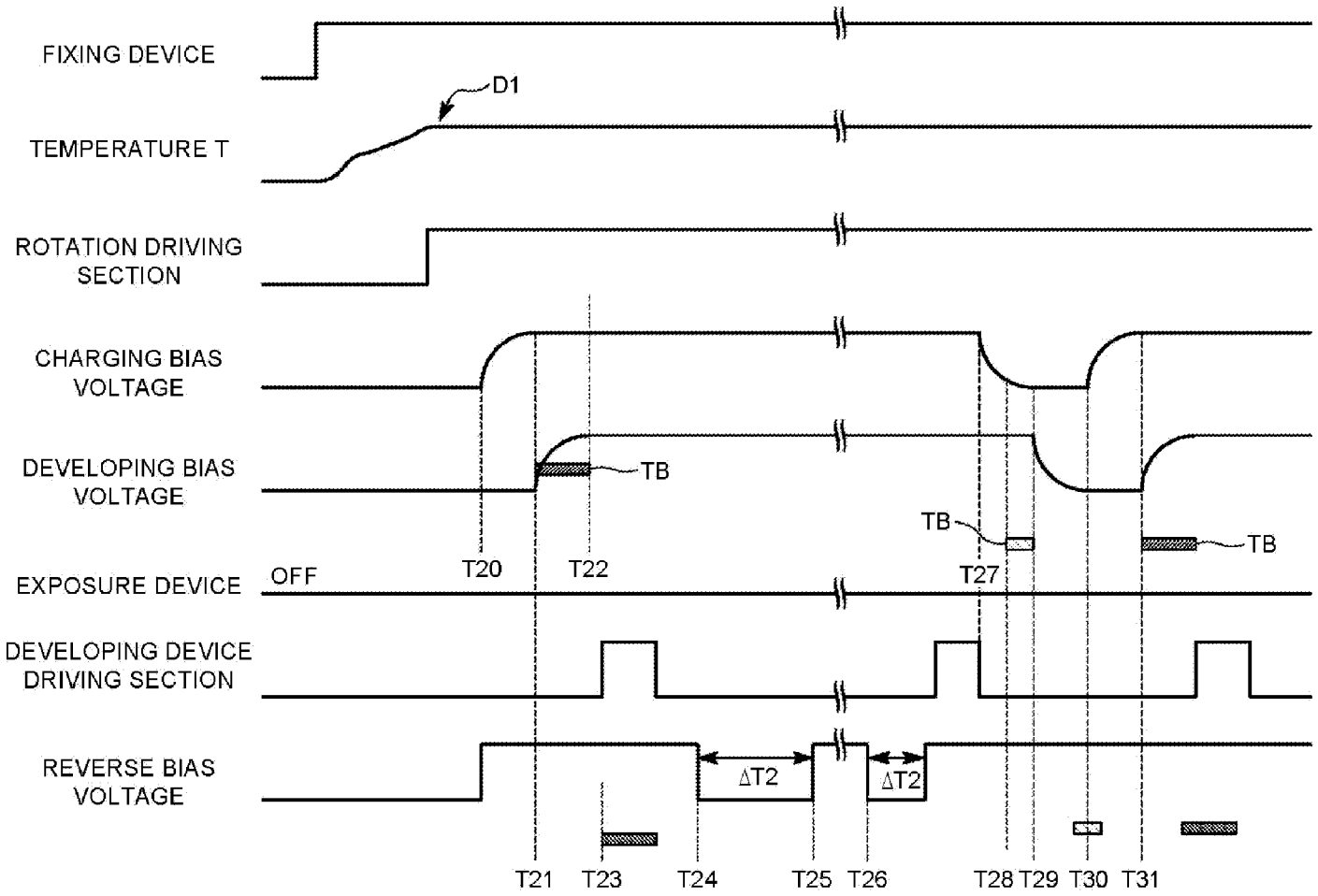
FIG. 8 is a diagram illustrating an operation timing of a control section in the decoloring mode according to the second embodiment.

Next, the operations of the control section 14*a* in the decoloring mode are described with reference to the accompanying drawings. FIG. 7 is a diagram illustrating the operation flow of the control section 14*a* in the decoloring mode. FIG. 8 is an operation timing chart of the control section 14*a* in the decoloring mode. Further, the paper printed with the decolorable toner is set in the paper feed section 10 after being used.

The user executes an operation for decoloring an image. For example, the user presses a start button which is arranged on the operation section of the operation panel section 40 to be used for decoloring image. The operation panel section 40 acquires the operation information for instructing the control section 14*a* to execute the decoloring mode. In this way, the control section 14*a* executes the decoloring mode.

The control section 14*a* drives the fixing device 13 (ACT 301). The control section 14*a* sends a signal to the fixing device driving section 131. If the signal is received from the control section 14*a*, the fixing device driving section 131 applies a voltage to the heat source. The temperature of the fixing device 13 is raised through the heat generated by the heat source.

The first determination section 141 acquires a temperature D from the temperature sensor 132 every a certain period. The first determination section 141 determines whether or not the temperature D is above the decoloring temperature D1 (ACT 302). In a case where it is determined that the temperature D is above the decoloring temperature D1 (YES in ACT 302), the driving processing section 143*a* outputs the first driving signal to the rotation driving section 42. In a case where it is determined that the temperature D is below the decoloring temperature D1 (NO in ACT 302), the first determination section 141 executes the processing in ACT 301 again. If the first driving signal is received, the rotation driving section 42 drives the photoconductor 21 and the intermediate transfer belt 3 (ACT 303).

The driving processing section 143*a* outputs the first bias voltage signal to the charging bias voltage section 71 at a timing T20. If the first bias voltage signal from the driving processing section 143*a* is received, the charging bias voltage section 71 applies a charging bias voltage to the charging device 22 (ACT 304).

The driving processing section 143*a* outputs the fifth bias voltage signal to the secondary transfer bias voltage section 74 at the timing T20. If the fifth bias voltage signal from the control section 14*a* is received, the secondary transfer bias voltage section 74 applies a reverse bias voltage to a roller facing the secondary transfer roller 81 (ACT 305).

The driving processing section 143*a* outputs the second bias voltage signal to the developing bias voltage section 72 at a timing T21. If the second bias voltage signal is received from the driving processing section 143*a*, the developing bias voltage section 72 applies a developing bias voltage to the developing roller 231 (ACT 306). The time period between the timings T20 and T21 is set to the timing at which the carrier attraction is not caused. Thus, the time period between the timings T20 and T21 is set to be shorter than a time period between the timings T20 and T22. The time period between the timings T20 and T22 is the time taken to move the surface of the photoconductor 21 for a distance between the charging device 22 and the developing roller 231. Further, the timing T22 is a time when the charged portion of the photoconductor 21 reaches the position of the developing roller 231. Thus, during the time period between the timings T21 and T22, since the potential of the developing roller 231 is higher than the surface potential of the photoconductor 21, a toner band TB is developed on the photoconductor 21.

The driving processing section 143*a* outputs the second driving signal to the developing device driving section 43. If the second driving signal is received, the developing device driving section 43 drives the developing roller 231 (ACT 307). For example, the developing device driving section 43 drives the developing roller 231 to rotate for one circle. Then, the developing device driving section 43 enables the developing roller 231 to stop its rotation. After the toner band TB is developed, the developing roller 231 is driven to prevent the carrier from being adhered to the photoconductor 21. If the toner in the developer in contact with the photoconductor 21 is supplied as a toner band, the toner concentration of the developer of the part where the developing roller 231 is contacted with the photoconductor 21 is reduced locally. In this state, if the driving of the developing roller 231 is continued to be stopped, it is likely to cause a carrier adhesion to the photoconductor 21. Thus, the developing device driving section 43 drives the developing roller 231 after the toner band TB is developed.

The developed toner band TB is transferred to the intermediate transfer belt 3 which abuts against the photoconductor 21. The transferred toner band is conveyed to the secondary transfer roller 81 through the intermediate transfer belt 3. The transferred toner band reaches the secondary transfer roller 81 (timing 23). At this time, a reverse bias voltage is applied to the opposing roller 82. That is, an electric field of which the direction is opposite to that of an electric field when a secondary transfer bias voltage is applied is generated at a space between the secondary transfer roller 81 and the opposing roller 82. Thus, the transferred toner band passes through the secondary transfer roller 81 without being adhered to the secondary transfer roller 81.

The second determination section 142 determines whether or not the detection signal is detected from the paper sensor 11 (ACT 308). If it is determined that the detection signal isn't detected (NO in ACT 308), the second determination section 142 determines whether or not the detection signal is detected from the paper sensor 11 (ACT 308). If it is determined that the detection signal is detected (YES in ACT 308), the driving processing section 143*a* calculates the time taken to move the paper from the paper sensor 11 to the secondary transfer section. Then, the driving processing section 143*a* stops the output of the fifth bias voltage signal (ACT 309). The secondary bias voltage section 74 stops the applying of the reverse bias voltage to the opposing roller 82. Then, the driving processing section 143*a* stops the output of the fifth bias voltage signal during a time period of a time 1T2 from a moment (timing T24) the paper reaches the secondary transfer roller 81. The ΔT2 is the time interval from the moment the paper reaches the secondary transfer roller 81 to the moment (timing T25) the paper passes through the secondary transfer roller 81. If the paper passes through the secondary transfer roller 81, the driving processing section 143*a* outputs the fifth bias voltage signal to the secondary transfer bias voltage section 74 (ACT 310).

The control section 14*a* determines whether or not the decoloring mode is ended (ACT 311). In a case in which the decoloring mode is ended (YES in ACT 311), the control section 14*a* clears the time count after a moment the decoloring mode is started (ACT 312). Then, the control section 14*a* enters the operation when the decoloring mode is stopped. In a case in which the decoloring mode is not ended (NO in ACT 311), the control section 14*a* determines whether or not a given time elapses after the decoloring mode is started (ACT 313). In a case in which the given time doesn't elapse (NO in ACT 313), the control section 14*a* continues the decoloring mode (ACT 308). In a case in which the given time elapses after the decoloring mode is started (YES in ACT 313), the control section 14*a* develops the toner band on the photoconductor 21 (ACT 314). For example, the driving processing section 143*a* stops the output of the first bias voltage signal to the charging bias voltage section 71. The charging bias voltage section 71 stops the applying of the charging bias voltage to the charging device 22. The driving processing section 143*a* stops the output of the second bias voltage signal to the developing bias voltage section 72 at a timing T29. The developing bias voltage section 72 stops the applying of the developing bias voltage to the developing roller 231.

In order to prevent the carrier adhesion to the photoconductor 21, a time period between the timings T27 and T29 is set to be longer than a time period between the timings T27 and T28. The time period between the timings T27 and T28 is the time taken to move the surface of the photoconductor 21 for a distance between the charging device 22 and the developing roller 231. Thus, even if the part of the photoconductor 21 where the surface potential is low reaches the developing position, the driving processing section 143*a* doesn't stop the applying of the developing bias voltage to the developing roller 231. During the time period between the timings T28 and T29, the potential of the developing roller 231 becomes higher than the surface potential of the photoconductor 21. Thus, the toner band TB is developed on the photoconductor 21.

Further, the driving processing section 143*a* outputs the first bias voltage signal to the charging bias voltage section 71 at a timing T30. If the first bias voltage signal from the driving processing section 143*a* is received, the charging bias voltage section 71 applies the charging bias voltage to the charging device 22. Then, the driving processing section 143*a* outputs the second bias voltage signal to the developing bias voltage section 72 at a timing T31. The time period between T30 and T31 is set to be shorter than a time taken to move the surface of the photoconductor 21 for a distance between the charging device 22 and the developing roller 231. If the second bias voltage signal is received from the driving processing section 143*a*, the developing bias voltage section 72 applies the developing bias voltage to the developing roller 231. The time period between the timings T30 and T31 is set to a time when the carrier attraction is not caused. Thus, the time period between the timings T30 and T31 is set to be shorter than a time taken to move the surface of the photoconductor 21 for a distance between the charging device 22 and the developing roller 231. As a result, the potential of the developing roller becomes higher than the potential of the surface of the photoconductor during the period from the timing T31 to the moment the charged portion of the photoconductor 21 reaches the position of the developing roller. Thus, the toner band is developed on the photoconductor 21.

After the toner band is developed, the control section 14*a* clears the count of the elapsed time (ACT 315). The secondary transfer bias voltage section 74 keeps applying the reverse bias voltage to the opposing roller 82 during the period when the processing in ACTs 310-315 is carried out. Thus, it is possible for the toner band to pass through the secondary transfer roller 81 without being adhered to the secondary transfer roller 81. Further, the developed toner band is moved to the cleaner blade 201. Then, the decolorable toner of the toner band serves as a lubricant, thereby reducing the friction force between the cleaner blade 201 and the photoconductor 21. Further, before the toner band serving as the lubricant is developed, the developing device driving section 43 may drive the developing roller 231 to rotate for one circle. This is because the toner on the developing roller 231 will be reduced locally as the developing roller 231 and the photoconductor 21 are contacted with each other at the same position. That is, the toner band can be developed certainly by rotating the developing roller 231 slightly before the toner band is developed. Further, it is preferable that the developing roller 231 is stopped when the charging bias voltage and the developing bias voltage are applied and stopped. In this way, the image density of the toner band can be prevented from being higher than a necessary image density.

Further, the operations when the decoloring mode is stopped are the same as that in the first embodiment, and therefore the description thereof is not provided.

In this way, even if the decoloring mode is continued to be executed for a long time, it is possible to suppress the curling of blade. It is also possible to prevent the secondary transfer roller 81 from being stained by toner.

In accordance with at least one embodiment described above, the image forming apparatus according to the embodiment comprises the image forming section 1, the transfer section 8, the transfer bias voltage control section (secondary transfer bias voltage section 74), the decoloring section (fixing device 13) and the control section 14. The image forming section 1 forms the toner image with decolorable toner. The transfer section 8 transfers the toner image to the medium. The transfer bias voltage control section controls the transfer bias voltage to be applied to the transfer section 8. The decoloring section decolors the decolorable toner on the medium. The control section 14 controls the transfer bias voltage control section to form, in a case where the decoloring section decolors the medium, an electric field of which the direction is opposite to that of an electric field formed at the time of an image formation. In this way, it is possible to prevent the secondary transfer roller 81 of the transfer section 8 from being stained by the toner band.

In the embodiments as stated above, the image forming apparatus may be the image forming apparatus of an intermediate transfer system, or may not be the image forming apparatus of an intermediate transfer system. If the image forming apparatus is not the image forming apparatus of an intermediate transfer system, the intermediate transfer belt is not used. In this case, if an electric field in which the decolorable toner is moved towards the photoconductor is applied to the transfer section in advance, it is possible to prevent the transfer roller from being stained.

In the embodiments as stated above, the transfer bias voltage is stopped when the paper is passed through the transfer section 8; however, the present invention is not limited to this. For example, as long as the paper isn't charged with excessive charge, a bias voltage of which the absolute value is lower than that of the bias voltage (transfer bias voltage) used in a general transfer may also be applied.

Further, a program for realizing the whole or part of the functions of the image processing section described above is recorded in a computer-readable recording medium. Then, the functions aforementioned may be realized by executing the program recorded in the recording medium by the control section 14.

Further, the "computer-readable recording medium" is a removable medium and a storage section. For example, the removable medium is a flexible disc, a magnetic optical disc, a ROM and a CD-ROM. For example, the storage section is a hard disc arranged inside in a computer system. Further, the "computer-readable recording medium" is a network, a recording medium that keeps a program dynamically for a period of a short time and a recording medium that keeps a program for a certain time. For example, the network is the Internet. For example, the recording medium that keeps a program dynamically is a communication wire in a case of sending the program via a communication line. For example, the recording medium that keeps a program for a certain time is a server or a volatile memory inside the computer system serving as a client. Further, the program may be one for realizing part of the functions aforementioned. Further, the program may be one capable of realizing the aforementioned functions through the combination with the program already recorded in the computer system.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

an image forming section configured to forma toner image with decolorable toner;

a transfer section configured to transfer the toner image on a medium;

a bias voltage control section configured to control a bias voltage to be applied to the transfer section;

a decoloring section configured to decolor the decolorable toner on the medium; and a control section configured to control the bias voltage control section to form, in a case where the decoloring section decolors the decolorable toner on the medium, an electric field of which the direction is opposite to an electric field formed at the time of an image formation.

2. The image forming apparatus according to claim 1, wherein when the decoloring section decolors the decolorable toner on the medium and the medium is on the transfer section, the absolute value of the bias voltage applied to the transfer section is lower than the absolute value of the bias voltage applied to the transfer section when the toner image is transferred.

3. The image forming apparatus according to claim 1, wherein decoloring section performs fixing and decoloring the decolorable toner on the medium and the decoloring section is heated during the decoloring process to a temperature higher than a temperature the decoloring section is heated to during the fixing process.

4. The image forming apparatus according to claim 1, wherein the control section applies, when the decoloring section ends the decoloring of the decolorable toner on the medium, each of the positive bias voltage and the negative bias voltage to the transfer section at least once.

5. The image forming apparatus according to claim 1, comprising:

a developing device configured to enable the decolorable toner to be adhered to a photoconductor and form a toner image on the photoconductor, wherein the control section develops a belt-like toner image on the photoconductor in a case where the decoloring section continues to decolor the medium for a given time.

6. The image forming apparatus according to claim 5, wherein the control section drives the developing device before the belt-like toner image is developed.

7. The image forming apparatus according to claim 5, wherein the control section drives the developing device after the belt-like toner image is developed.

8. An image forming method, including:

forming a toner image with decolorable toner by an image forming section;

transferring the toner image on a medium by a transfer section;

controlling a bias voltage to be applied to the transfer section by a bias voltage control section;

decoloring the decolorable toner by a decoloring section; and controlling the bias voltage control section to form, in a case where the decoloring section decolors toner image on a medium, an electric field of which the direction is opposite to an electric field formed at the time of an image formation by a control section.

* * * * *